US006663368B2

(12) United States Patent
Saiz

(10) Patent No.: US 6,663,368 B2
(45) Date of Patent: Dec. 16, 2003

(54) SPHERICAL GEAR PUMP

(76) Inventor: Manuel Munoz Saiz, San Emilio 16, 1, 3, Madrid (ES), 28017

( * ) Notice: Subject to any disclaimer, the term of this patent is extended or adjusted under 35 U.S.C. 154(b) by 0 days.

(21) Appl. No.: 10/002,293

(22) Filed: Nov. 15, 2001

(65) Prior Publication Data

US 2002/0037231 A1 Mar. 28, 2002

Related U.S. Application Data

(63) Continuation of application No. 09/405,637, filed on Sep. 24, 1999, now abandoned.

(30) Foreign Application Priority Data

Oct. 14, 1998 (ES) ..... P9802126
Jul. 6, 1999 (ES) ..... P9901492

(51) Int. Cl.[7] ..... F04C 18/00
(52) U.S. Cl. ..... 418/206.5; 418/206.1; 418/178
(58) Field of Search ..... 418/206.5, 206.1, 418/178

(56) References Cited

U.S. PATENT DOCUMENTS 3,106,912 A * 10/1963 Kahlert ..... 418/141
3,595,013 A * 7/1971 Brille et al. ..... 123/561
6,138,646 A * 10/2000 Hansen et al. ..... 418/206.5

FOREIGN PATENT DOCUMENTS

| | | | |
|---|---|---|---|
| DE | 2200048 | * 1/1972 | |
| JP | 55159351 A | * 12/1980 | ..... F16H/1/06 |
| JP | 61270523 A | * 11/1986 | ..... F16D/3/18 |
| JP | 62203988 A | * 9/1987 | ..... F04C/15/00 |
| JP | 04219560 A | * 8/1992 | ..... F16H/55/08 |
| JP | 04302743 A | * 10/1992 | ..... F16H/1/26 |

* cited by examiner

*Primary Examiner*—Thomas Denion
*Assistant Examiner*—Theresa Trieu
(74) *Attorney, Agent, or Firm*—Robert M. Schwartz

(57) ABSTRACT

A spherical gear pump that comprises two rotors, or geared spheres, with the teeth arranged around them in a circular band at right angles to their axis of rotation: the pump spheres are covered by close-fitting spherical cases or housings except at the central or most internal part of the connection between the gears on the two spheres, the fluid contained in the cavity created between the most external gears and the case or housing is moved during rotation from the intake to the outlet, one sphere is driven by its shaft and the other is dragged by the gearing between the two.

8 Claims, 3 Drawing Sheets

SPHERICAL GEAR PUMP

CROSS REFERENCES TO RELATED APPLICATIONS

This patent claims the priority date of U.S. patent application Ser. No. 09/405,637 filed on Sep. 24, 1999, now abandoned, which claimed the priority date of Spanish patent P9802126 filed on Oct. 14, 1998 and Spanish patent P9901492 filed on Jul. 6, 1999. The basis for priority in that case was the Paris Convention for the Protection of Intellectual Property (613 O.G. 23, 53 Stat 1748). The Spanish applications were filed in The Official Patent and Trademark Office of Spain.

BACKGROUND OF THE INVENTION

1. Field of the Invention

Pumps, compressors, fluid motors and engines.

2. Description of the Related Art

There are alternating or vane pumps, compressors, etc. which are complicated, and of the turbine or fin type requiring high speeds to operate and of limited internal hermetic seal.

SUMMARY OF THE INVENTION

The drawbacks referred to above are eliminated with this invention that consists of a spherical gear pump comprising two rotors or geared spheres, with the teeth arranged around them in a circular band at right angles to their axis of rotation the pump spheres are covered by close-fitting spherical cases or housings except at the central or most internal part of the connection between the gears on the two spheres. The fluid contained in the cavity created between the most external gears and the case is moved during rotation from the intake to the outlet.

The spherical gear pump operates similarly to a cylindrical pump. At least two teeth per sphere can be used, though the most useful are those with 4–6 feet. If 2 or 3 are used, the movement is transmitted between the two spheres by means of additional gears. The spheres and their coverings may he lightweight hard material and may also be coated in a hard or hardened material. They may be hollow inside.

The sphere is driven by its shaft and the other is dragged by the gearing between the two.

In the area of the spheres close to the shafts, or on the shafts themselves, there may be some projections or washers which maintain a precision gauged distance between the spheres and their cases or housings. Except for low speeds, bearings will be needed on the ends of the spheres' rotary shafts.

The lubrication systems are similar to those of existing pumps, compressors, etc.

When the pump is used like compressor in internal combustion engines, said pump sends the air to a combustion chamber where it is compressed and reacts with the fuel and expands driving a low or mean speed turbine.

Benefits: good hermetic seal, particularly thanks to the spherical form of both the rotors and the housings, so that expansion is more even: they are useful as vacuum pumps. It is the best of the pumps and compressors (and motors because it is reversible), being simple and economical. Unlike fin compressors, high speeds are not required, which is useful for addition as a compressor for gas turbines. Extremely small dimensions are possible, and valves are not required. Few parts are employed, and there is no alternating movement. Highly reliable, and good performance. The power/weight ratio and power/volume ratios are similar to those of existing systems.

DETAILED DESCRIPTION OF THE PREFERRED EMBODIMENTS

Figure 1:
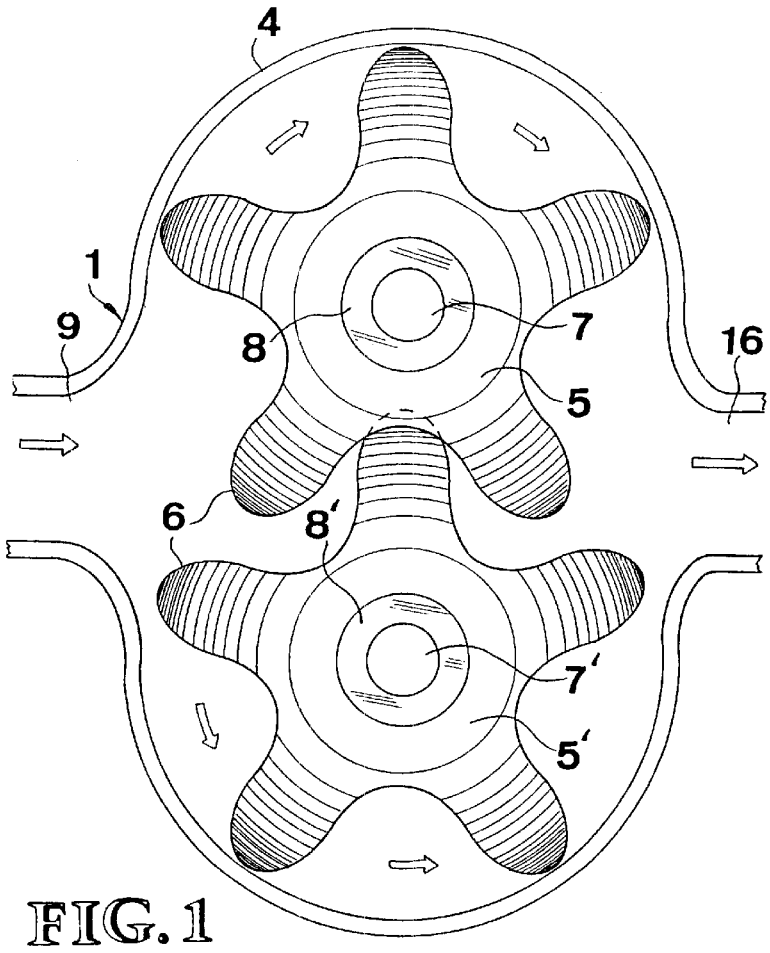
FIGS. 1 and 2 show side, schematic, partial, cross-section views of the pump, compressor, motor, etc., of the invention.

FIG. 1 comprises the pump or compressor 1, case or housing 4, the rotors or geared spheres 5 and 5' with five teeth, the rotary shafts 7 and 7', and the projections or washers 8 and 8' which maintain a precision gauged distance between the spheres and their housings. When it rotates driving one of the shafts, the fluid contained in the cavity created between the most external gears and the cases or housings is moved during rotation from the intake 9 to the outlet 16, as it is shown with arrows.

Figure 2:
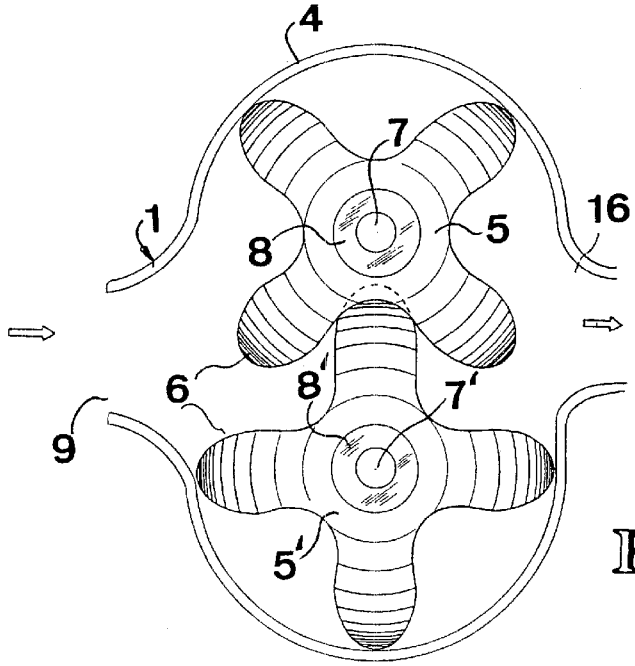

FIG. 2 comprises the pump or compressor 1, the case or housing 2, the rotors or geared spheres 5 and 5' with four teeth 6, the rotary shafts 7 and 7', and the projections or washers 8 and 8' that create a gap. It works the same way as in FIG. 1.

Figure 3:
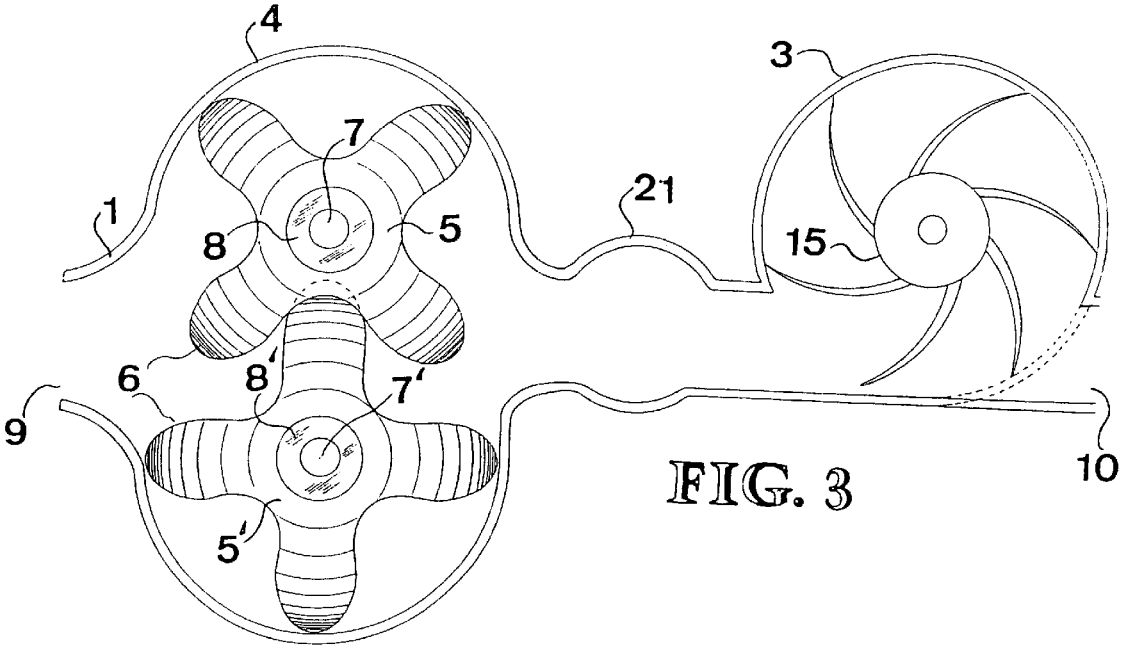
FIG. 3 shows a side, schematic, partial, cross-section view of an engine with the pump in the invention.

FIG. 3 comprises the pump or compressor 1, the combustion chamber 21 and the turbine 3 with rotor 15, the pump case or housing 4, the rotors or geared spheres 5 and 5', with their teeth 6, the rotary shafts 7 and 7', the gap annular washers or springs 8 and 8', where 9 is the compressor or air intake, said compressor sends the air into the combustion chamber where it reacts with the fuel and expands driving the good hermetic seal radial blades wheel, supplying the gas fluid exhaust against the blades of a half of the turbine 3, which is exhausted to the atmosphere through outlet 10.

Figure 4:
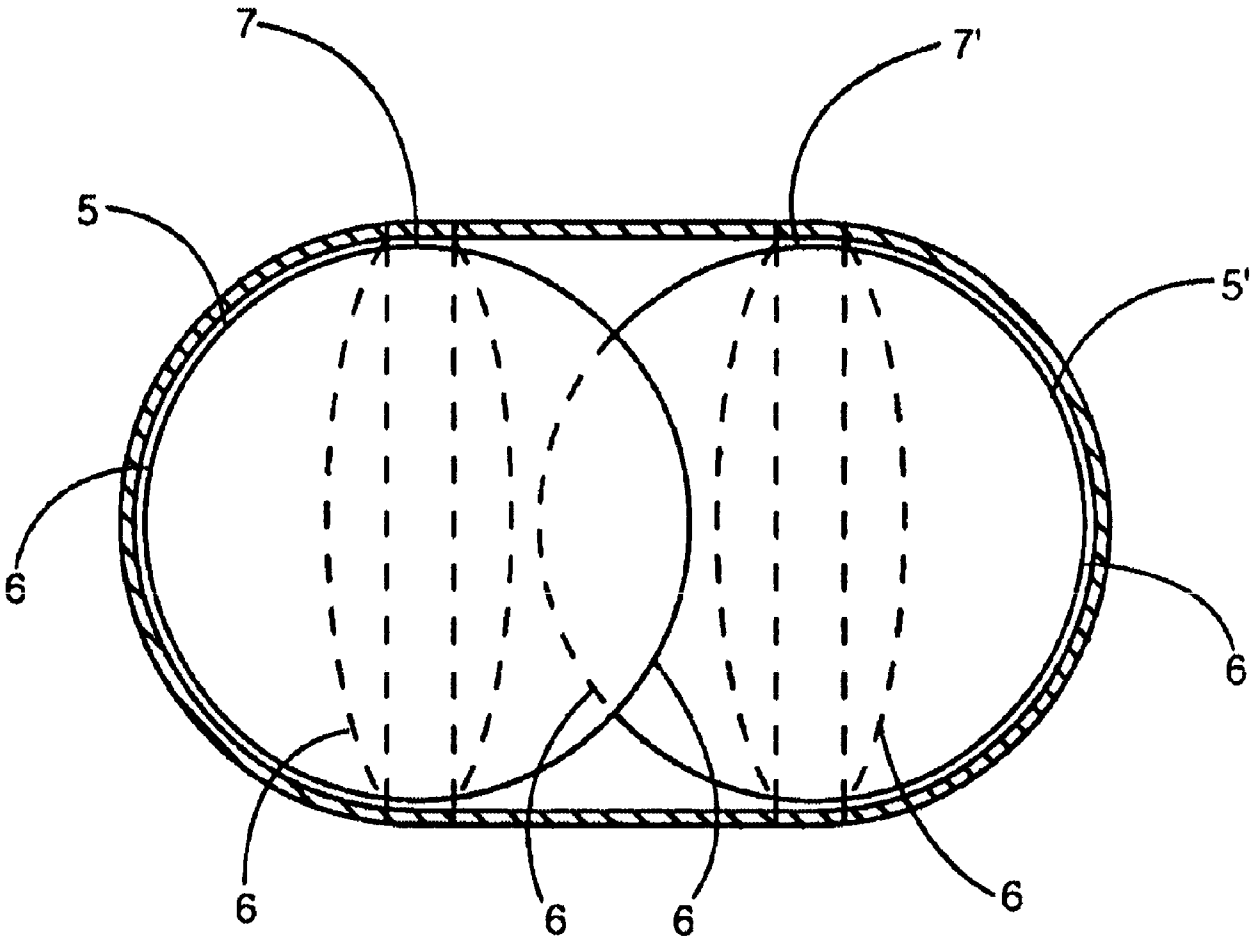
FIG. 4 is a cross-section view of a geared sphere shown in FIG. 3.

FIG. 4 illustrates a cross-section view of geared sphere 5', as shown in FIGS. 2 and 3, and includes teeth 6.

What is claimed is:

1. A gear pump comprising geared spheres, with teeth arranged around the geared spheres in a circular band at right angles to their axis of rotation, said teeth extending into at least one of said geared spheres, wherein said geared spheres are substantially covered by close-fitting case or housing having the inner surface equally distant from a center at all points except at a central or most internal part of the connection between said gears on said two spheres, and wherein fluid contained in a cavity created between said geared spheres and said case or housing is moved during rotation from an intake to an outlet.

2. The spherical gear pump according to claim 1 wherein said spheres and their cases are constructed of lightweight and hard material.

3. The spherical gear pump according to claim 1 wherein said spheres and their cases are coated in a hard or hardened material.

4. The spherical gear pump according to claim 1 wherein one sphere is driven by its shaft and the other is dragged by the gearing between said two spheres.

5. The spherical gear pump according to claim 1 wherein the area of said spheres close to said shafts, or on said shafts themselves, include projections which maintain a precision gauged distance between said spheres and their cases or housings.

6. The spherical gear pump according to claim 1 wherein the area of said spheres close to said shafts, or on said shafts themselves, include washers which maintain a precision gauged distance between said spheres and their cases or housings.

7. The spherical gear pump according to claim 1 wherein each said sphere has at least two teeth.

8. The spherical gear pump according to claim 1 wherein said pump is used as a compressor in an internal combustion engine, said pump sends the air to a combustion chamber where it is compressed and reacts with the fuel and expands driving a low or mean speed turbine.

* * * * *